US010058923B2

(12) United States Patent
Ishikawa et al.

(10) Patent No.: US 10,058,923 B2
(45) Date of Patent: Aug. 28, 2018

(54) METHOD FOR MANUFACTURING ELECTRODE MATERIAL AND ELECTRODE MATERIAL

(71) Applicant: MEIDENSHA CORPORATION, Tokyo (JP)

(72) Inventors: Keita Ishikawa, Tokyo (JP); Kaoru Kitakizaki, Saitama (JP); Shota Hayashi, Tokyo (JP)

(73) Assignee: MEIDENSHA CORPORATION, Tokyo (JP)

( * ) Notice: Subject to any disclaimer, the term of this patent is extended or adjusted under 35 U.S.C. 154(b) by 0 days.

(21) Appl. No.: 15/508,256

(22) PCT Filed: Aug. 27, 2015

(86) PCT No.: PCT/JP2015/074160
§ 371 (c)(1),
(2) Date: Mar. 2, 2017

(87) PCT Pub. No.: WO2016/039154
PCT Pub. Date: Mar. 17, 2016

(65) Prior Publication Data

US 2017/0282249 A1 Oct. 5, 2017

(30) Foreign Application Priority Data

Sep. 11, 2014 (JP) ..... 2014-184792

(51) Int. Cl.
*B22F 3/26* (2006.01)
*B22F 9/04* (2006.01)
(Continued)

(52) U.S. Cl.
CPC ..... *B22F 3/26* (2013.01); *B22F 3/15* (2013.01); *B22F 7/008* (2013.01); *B22F 7/06* (2013.01);
(Continued)

(58) Field of Classification Search
CPC ..... B22F 3/15; B22F 3/26; B22F 3/16; B22F 9/04; B22F 2301/10; B22F 2301/20;
(Continued)

(56) References Cited

U.S. PATENT DOCUMENTS 4,836,978 A 6/1989 Watanabe et al.
5,330,702 A 7/1994 Kippenberg et al.
(Continued)

FOREIGN PATENT DOCUMENTS

EP 3 106 249 A1 12/2016
JP 63-62122 A 3/1988
(Continued)

OTHER PUBLICATIONS

Rieder et al., The Influence of Composition and Cr Particle Size of Cu/Cr Contacts on Chopping Current, Contact Resistance, and Breakdown Voltage in Vacuum Interrupters, IEEE Transactions on Components, Hybrids, and Manufacturing Technology, vol. 12, No. 2, Jun. 1989, pp. 273-283.
(Continued)

*Primary Examiner* — Colleen P Dunn
*Assistant Examiner* — Anthony M Liang
(74) *Attorney, Agent, or Firm* — Foley & Lardner LLP

(57) ABSTRACT

What is disclosed is an electrode material including a sintered body containing a heat resistant element and Cr and being infiltrated with a highly conductive material. A powder mixture of a heat resistant element powder and a Cr powder is subjected to a provisional sintering in advance, thereby causing solid phase diffusion of the heat resistant element and Cr. After a Mo—Cr solid solution obtained by the provisional sintering is pulverized, the pulverized Mo—Cr solid solution powder is molded and sintered. A sintered body obtained by sintering is subjected to a HIP treatment. The highly conductive metal is disposed on the sintered
(Continued)

body after the HIP treatment, and infiltrated into the sintered body by heating at a predetermined temperature. By conducting the HIP treatment, the withstand voltage capability and current-interrupting capability of the electrode material are improved.

8 Claims, 3 Drawing Sheets

(51) Int. Cl.

| | |
|---|---|
| ***B22F 3/15*** | (2006.01) |
| ***C22C 1/08*** | (2006.01) |
| ***C22C 9/00*** | (2006.01) |
| ***C22C 27/04*** | (2006.01) |
| ***C22C 1/04*** | (2006.01) |
| ***H01H 1/02*** | (2006.01) |
| ***B22F 7/00*** | (2006.01) |
| ***B22F 7/06*** | (2006.01) |
| *C22C 27/06* | (2006.01) |

(52) U.S. Cl.
CPC ..... *B22F 9/04* (2013.01); *C22C 1/045* (2013.01); *C22C 1/0458* (2013.01); *C22C 1/0475* (2013.01); *C22C 1/08* (2013.01); *C22C 9/00* (2013.01); *C22C 27/04* (2013.01); *H01H 1/0206* (2013.01); *B22F 2998/10* (2013.01); *C22C 27/06* (2013.01)

(58) Field of Classification Search
CPC ..... B22F 7/008; B22F 2998/10; C22C 1/045; C22C 1/04; C22C 1/08; C22C 27/04; C22C 27/06; H01H 1/0206
See application file for complete search history.

(56) References Cited

U.S. PATENT DOCUMENTS

| | | | |
|---|---|---|---|
| 6,551,374 | B2 | 4/2003 | Doh et al. |
| 2013/0199905 | A1 | 8/2013 | Noda et al. |
| 2015/0200059 | A1 | 7/2015 | Noda et al. |
| 2016/0369373 | A1 | 12/2016 | Kitakizaki et al. |
| 2017/0232520 | A1 | 8/2017 | Kitakizaki et al. |

FOREIGN PATENT DOCUMENTS

| | | | | |
|---|---|---|---|---|
| JP | 04-505985 | A | 10/1992 | |
| JP | 5-287320 | A | 11/1993 | |
| JP | 09-194906 | A | 7/1997 | |
| JP | 2002-180150 | A | 6/2002 | |
| JP | 2004-211173 | A | 7/2004 | |
| JP | 2006-169547 | A | 6/2006 | |
| JP | 2012-007203 | A | 1/2012 | |
| WO | WO 2011162398 | A1 * | 12/2011 | ..... C22C 1/0425 |
| WO | WO 2015/133263 | A1 | 9/2015 | |
| WO | WO 2015/133264 | A1 | 9/2015 | |

OTHER PUBLICATIONS

Tanaka et al., Sintering of Advanced Materials, Applications of Hot Isostatic Pressing, 1987, p. 207, Uchida Rokakuho Publishing Co., Ltd.

USPTO Notice of Allowance, U.S. Appl. No. 15/318,448, dated Jun. 6, 2018, 10 pages.

* cited by examiner

METHOD FOR MANUFACTURING ELECTRODE MATERIAL AND ELECTRODE MATERIAL

TECHNICAL FIELD

The present invention relates to a technique for controlling composition of an electrode material.

BACKGROUND OF THE INVENTION

An electrode material used for an electrode of a vacuum interrupter (VI) etc. is required to fulfill the properties of: (1) a great current-interrupting capacity; (2) a high withstand voltage capability; (3) a low contact resistance; (4) a good welding resistance; (5) a lower consumption of a contact point; (6) a small interrupting current; (7) an excellent workability; (8) a great mechanical strength; and the like.

A copper (Cu)-chromium (Cr) electrode has the properties of a good current-interrupting capacity, a high withstand voltage capability, a good welding resistance and the like and has widely been used as a material for a contact point of a vacuum interrupter. The Cu—Cr electrode has been reported that Cr particles having a finer particle diameter are more advantageous in terms of the current-interrupting capacity and the contact resistance (for example, by Non-Patent Document 1).

As a method for producing a Cu—Cr electrode material, there are generally two well-known methods, i.e. a sintering method (a solid phase sintering method) and a infiltration method. In the sintering method, Cu having a good conductivity and Cr having an excellent arc resistance are mixed at a certain ratio, and the mixed powder is press-molded and then sintered in a non-oxidizing atmosphere (for example, in a vacuum atmosphere), thereby producing a sintered body. The sintering method has the advantage that the composition between Cu and Cr can freely be selected, but it is higher in gas content than the infiltration method and therefore has a fear of being inferior to the infiltration method in mechanical strength.

On the other hand, in the infiltration method, a Cr powder is press-molded (or not molded) and charged into a container and then heated to temperatures of not lower than the melting point of Cu in a non-oxidizing atmosphere (for example, in a vacuum atmosphere) to infiltrate Cu into airspaces defined among Cr particles, thereby producing an electrode. Although the composition ratio between Cu and Cr cannot freely be selected, the infiltration method has the advantage that a material smaller than the sintering method in gas content and the number of airspaces is obtained, the material being superior to the sintering method in mechanical strength.

In recent years, conditions for the use of the vacuum interrupter are getting restricted while the application of the vacuum interrupter to a capacitor circuit is increasingly developed. In a capacitor circuit, a voltage which is twice or three times larger than the usual one is applied between electrodes, so that it is assumed that a surface of a contact point receives significant damages by arc generated at current-interrupting time or current-starting time, thereby causing reignition of arc easily. For example, when closing electrodes under a state of applying circuit voltage, an electric field between a movable electrode and a fixed electrode is so strengthened as to cause an insulation breakdown before the electrodes are closed. An arc is to be generated at this time, and the heat of the arc cause melting in the surfaces of the contact points of the electrodes. After the electrodes have been closed, the melted portions are reduced in temperature by thermal diffusion so as to be welded. When opening the electrodes, the welded portions are stripped from each other and therefore the surfaces of the contact points are to be damaged. Hence, there has been desired an electrode material having better withstand voltage capability and current-interrupting capability than those of the conventional Cu—Cr electrode.

As a method for producing a Cu—Cr based electrode material excellent in electrical characteristics such as withstand voltage capability and current-interrupting capability, there is a method of producing an electrode where a Cr powder for improving the electrical characteristics and a heat resistant element powder (molybdenum (Mo), tungsten (W), niobium (Nb), tantalum (Ta), vanadium (V), zirconium (Zr) etc.) for refining the Cr powder are mixed into a Cu powder as a base material and then the mixed powder is charged into a mold and press-molded in order finally to obtain a sintered body (Patent Documents 1 and 2, for example).

To be more specific, a heat resistant element is added to a Cu—Cr based electrode material originated from Cr having a particle diameter of 200-300 μm, thereby refining Cr through a microstructure technique. That is, an alloying of Cr and the heat resistant element is accelerated, and thereby increasing deposition of fine Cr—X particles (where X is a heat resistant element) in the interior of the Cu base material structure. As a result, Cr particles having a particle diameter of 20-60 μm is uniformly dispersed in the Cu base material structure, in the form of including the heat resistant element in the interior thereof.

In order to improve an electrode material in electrical characteristic such as current-interrupting capability and withstand voltage capability, it is required that a content of Cr and that of a heat resistant element are large in the Cr base material and that Cr and particles where Cr and the heat resistant element are changed into a solid solution are miniaturized in particle diameter and then uniformly dispersed in the Cu base material.

PRIOR ART DOCUMENTS

Patent Documents

Patent Document 1: Japanese Patent Application Publication No. 2002-180150

Patent Document 2: Japanese Patent Application Publication No. 2012-007203

Patent Document 3: Japanese Patent Application Publication No. 2004-211173

Patent Document 4: Japanese Patent Application Publication No. 63-062122

Patent Document 5: Japanese Patent Application Publication No. 05-287320

Non-Patent Document

Non-Patent Document 1: RIEDER, F. u.a., "The Influence of Composition and Cr Particle Size of Cu/Cr Contacts on Chopping Current, Contact Resistance, and Breakdown Voltage in Vacuum Interrupters", IEEE Transactions on Components, Hybrids, and Manufacturing Technology, Vol. 12, 1989, 273-283

SUMMARY OF THE INVENTION

An object of the present invention is to provide an electrode material having a withstand voltage capability and current-interrupting capability greater than those of conventional Cu—Cr electrode materials, and additionally, a particular object of the present invention is to improve a filling rate of a porous material to be infiltrated with a highly conductive metal such as Cu, silver and the like in an electrode material produced by infiltration method.

In infiltration method, molding of a porous material is performed by metallic molding or the like, for example; however, when increasing a molding pressure in order to improve the filling rate of the porous material, a mold gets conspicuously worn out so as to be possibly shortened in life.

An aspect of a method for producing an electrode material according to the present invention which can attain the above-mentioned object resides in a method for producing an electrode material, comprising a provisional sintering step of sintering a mixed powder containing a powder of a heat resistant element and a powder of Cr to obtain a solid solution where the heat resistant element and Cr are dissolved; a pulverizing step of pulverizing the solid solution to obtain a powder of the solid solution; a hot isostatic pressing treatment step of subjecting the powder of the solid solution or a molded body formed by molding the powder of the solid solution to a hot isostatic pressing treatment; and an infiltration step of infiltrating a metal having high conductivity into an objective body obtained by the hot isostatic pressing treatment after the hot isostatic pressing treatment.

Additionally, another aspect of the method for producing the electrode material according to the present invention which can attain the above-mentioned object resides in the above-mentioned process wherein a sintered body obtained by sintering the molded body is subjected to the hot isostatic pressing treatment.

Additionally, another aspect of the method for producing the electrode material according to the present invention which can attain the above-mentioned object resides in the above-mentioned process wherein a mixed quantity of Cr to the heat resistant element is four or less to one of the heat resistant element in weight ratio.

Additionally, another aspect of the method for producing the electrode material according to the present invention which can attain the above-mentioned object resides in the above-mentioned process wherein a filling rate of the objective body obtained by the hot isostatic pressing treatment is improved by 10% or more in the hot isostatic pressing treatment step.

An aspect of an electrode material according to the present invention which can attain the above-mentioned object resides in an electrode material, comprising a sintered body obtained by subjecting a solid solution powder containing a heat resistant element and Cr or a molded body of the solid solution powder to hot isostatic pressing treatment at a temperature lower than a melting point of the solid solution, the electrode material being formed by infiltrating a metal having a melting point lower than a melting point of the heat resistant element into the sintered body.

According to the above inventions, they can contribute to improving a withstand voltage capability and current-interrupting capability of an electrode material.

MODE(S) FOR CARRYING OUT THE INVENTION

Figure 1:
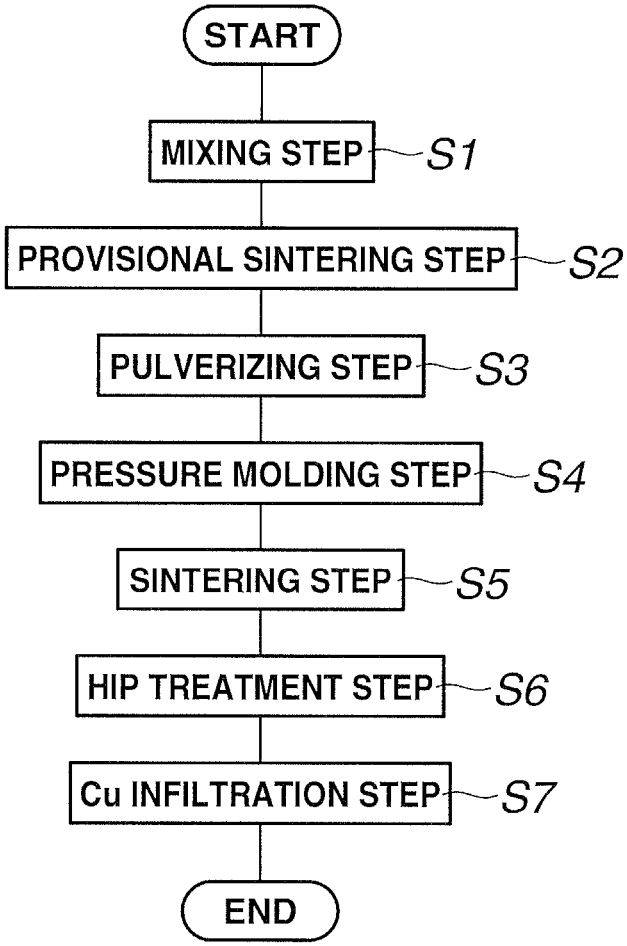
FIG. 1 A flow chart showing a method for producing an electrode material according to an embodiment of the present invention.

Referring now to the accompanying drawings, a method for producing an electrode material and an electrode material according to an embodiment of the present invention will be discussed in details. In the explanations of the embodiment, an average particle diameter (such as a median diameter d50) and a volume-based relative particle amount mean values which are measured by a laser diffraction particle size analyzer (available from CILAS under the trade name of CILAS 1090L) is shown unless otherwise specified.

First of all, in advance of the present invention, the inventors made studies on a relationship between the occurrence of restrike and the distributions of Cu and a heat resistant element (such as Mo and Cr). As a result, a large number of minute protrusions (for example, minute protrusions of several ten micrometers to several hundred micrometers) were found at a region of Cu smaller than heat resistant elements in melting point by observing the surface of an electrode that had met with restrike. These protrusions generate an intense electric field at their top parts, and hence sometimes result in a factor for reducing a current-interrupting capability and a withstand voltage capability. The formation of the protrusions is presumed to be established in such a manner that electrodes are melted and welded by a fed electric current and that the welded portions are stripped from each other in a subsequent current-interrupting time. As the result of performing studies on the current-interrupting capability and the withstand voltage capability of the electrode material on the basic of the above-mentioned presumption, the present inventors have achieved a finding that the formation of minute protrusions in the Cu region is suppressed while the probability of occurrence of restrike is lowered by reducing the particle size of the heat resistant element contained in the electrode and finely dispersing it and by finely uniformly dispersing the Cu region in the electrode surface. Additionally, an electrode contact point is supposed to cause a dielectric breakdown by its repeated opening/closing actions where particles of the heat resistant element on the electrode surface is pulverized and then the thus produced fine particles separate from the electrode surface; as the result of performing studies on an electrode material having a good withstand voltage capability in view of the above, the present inventors have achieved a finding that an effect of inhibiting the particles of the heat resistant element from being pulverized can be obtained when reducing the particle size of the heat resistant element contained in the electrode and finely dispersing it and when finely uniformly dispersing the Cu region in the electrode surface. As the results of having eagerly made studies on the particle diameter of the heat resistant element, the dispersibility of Cu, the withstand voltage capability of an electrode of a vacuum interrupter and the like in view of the findings as above, the present inventors achieved the completion of the present invention.

The present invention relates to a technique for controlling the composition of a metal (such as Cu, Ag)—Cr-heat resistant element (such as Mo, W and V) electrode material. In this invention, an electrode material used for a vacuum interrupter can be improved in a withstand voltage capability and current-interrupting capability, for example, by refining and uniformly dispersing Cr-containing particles while refining and uniformly dispersing a metal (such as Cu, Ag) structure which is a highly conductive component and also by providing a large content of a heat resistant element. Especially, the present invention is characterized in that Cr and a heat resistant element are provisionally sintered, an obtained solid solution is pulverized and molded, and Cu is infiltrated into an obtained molded body, and that the molded body is subjected to a hot isostatic pressing treatment (hereinafter referred to as "HIP treatment") before infiltration of Cu.

As a heat resistant element, an element selected from elements including molybdenum (Mo), tungsten (W), tantalum (Ta), niobium (Nb), vanadium (V), zirconium (Zr), beryllium (Be), hafnium (Hf), iridium (Ir), platinum (Pt), titanium (Ti), silicon (Si), rhodium (Rh) and ruthenium (Ru) can be used singly or in combination. Particularly, it is preferable to use Mo, W, Ta, Nb, V and Zr which are prominent in effect of refining Cr particles. In case of using a heat resistant element in the form of powder, the heat resistant element powder is provided with an average particle diameter of 2-20 μm, more preferably 2-10 μm, thereby allowing fining the Cr-containing particles (i.e., particles containing a solid solution of a heat resistant element and Cr) and uniformly dispersing them in an electrode material. If the heat resistant element has a content of 6-76 wt %, more preferably 32-68 wt % relative to the electrode material, it becomes possible to improve the electrode material in the withstand voltage capability and current-interrupting capability without impairing its mechanical strength and workability.

When Cr has a content of 1.5-64 wt %, more preferably 4-15 wt % relative to the electrode material, it is possible to improve the electrode material in the withstand voltage capability and current-interrupting capability without impairing its mechanical strength and workability. In case of using a Cr powder, particles of the Cr powder are provided with a particle diameter of, for example, −48 mesh (a particle diameter of less than 300 μm), more preferably −100 mesh (a particle diameter of less than 150 μm), much more preferably −325 mesh (a particle diameter of less than 45 μm). Thereby, it is possible to obtain an electrode material excellent in the withstand voltage capability and current-interrupting capability. A Cr powder having a particle diameter of −100 mesh is able to reduce the amount of a remanent Cr which can be a factor for increasing the particle diameter of Cu having been infiltrated into the electrode material. Additionally, though it is preferable to use Cr particles having a small particle diameter from the viewpoint of dispersing fined-Cr-containing particles in the electrode material, finer Cr particles are to increase an oxygen content in the electrode material more and more thereby reducing the current-interrupting capability. The increase of the oxygen content in the electrode material, which is brought about by decreasing the particle diameter of the Cr particles, is assumed to be caused by Cr being finely pulverized and oxidized. Hence if only it is possible to process Cr into a fine powder under a condition where Cr does not oxidize (e.g. in an inert gas), a Cr powder whose particle diameter is less than −325 mesh may be employed. It is preferable to use a Cr powder having a small particle diameter from the viewpoint of dispersing fined-Cr-containing particles in the electrode material.

As a metal to be infiltrated, it is possible to employ a highly conductive metal such as copper (Cu), silver (Ag), or an alloy of Cu and Ag. When these metals have a content of 20-70 wt %, more preferably 25-60 wt % relative to the electrode material, it is possible to reduce contact resistance of the electrode material without impairing the withstand voltage capability and current-interrupting capability. Incidentally, a content of a highly conductive metal which the electrode material includes is to be determined according to an infiltration step, so that the total of the heat resistant element, Cr, and the highly conductive metal, which are added into the electrode material, never exceeds 100 wt %.

Referring now to a flow chart shown in FIG. 1, a method for producing an electrode material according to an embodiment of the present invention will be discussed in details. Although the following explanations will be made by taking Mo as an example of the heat resistant element while taking Cu as an example of the highly conductive metal, similar results should be obtained even if using other heat resistant element powders or other highly conductive metals.

In a mixing step S1, a heat resistant element powder (for example, a Mo powder) and a Cr powder are mixed. Although the average particle diameters of the Mo powder and Cr powder are not particularly limited, it is preferable that the average particle diameter of the Mo powder is 2 to 20 μm while the particle diameter of the Cr powder is −100 mesh. With this, it is possible to provide an electrode material where a Mo—Cr solid solution is uniformly dispersed in a Cu phase. Furthermore, the Mo powder and the Cr powder are mixed such that the weight ratio of Cr to Mo is four or less to one, more preferably ⅓ or less to one, thereby making it possible to produce an electrode material having a good withstand voltage capability and current-interrupting capability.

In a provisional sintering step S2, a container reactive with neither Mo nor Cr (for example, an alumina container) is charged with a mixed powder obtained from the Mo powder and the Cr powder through the mixing step S1 (hereinafter referred to as "a mixed powder"), and then the mixed powder is subjected to a provisional sintering in a non-oxidizing atmosphere (such as a hydrogen atmosphere and a vacuum atmosphere) at a certain temperature (for example, a temperature of 1250 to 1500° C.). By performing the provisional sintering, a Mo—Cr solid solution where Mo and Cr are dissolved and diffused into each other can be obtained. In the provisional sintering step S2, it is not always necessary to conduct the provisional sintering until all of Mo and Cr form the solid solution; however, if a provisional sintered body where either one or both of a peak corresponding to Mo element and a peak corresponding to Cr element (which peaks are observed by X ray diffraction measurement) completely disappear (in other words, a provisional sintered body where either one of Mo and Cr is completely dissolved in the other one) is used, it is possible to obtain an electrode material having a better withstand voltage capability. Accordingly, in a case of the Mo powder being mixed in a larger amount, for example, the sintering temperature and the sintering time in the provisional sintering step S2 are selected so that at least the peak corresponding to Cr element disappears at the time of X ray diffraction measurement made on the Mo—Cr solid solution. In the other case where the Cr powder is mixed in a larger amount, the sintering temperature and the sintering time in the provisional sintering step S2 are selected so that at least the peak corresponding to Mo element disappears at the time of X ray diffraction measurement made on the Mo—Cr solid solution.

Additionally, in the provisional sintering step S2, pressure molding (or press treatment) may be conducted on the mixed powder before the provisional sintering. By conducting the pressure molding, the mutual diffusion of Mo and Cr is accelerated and therefore the provisional sintering time can be shortened while the provisional sintering temperature can be lowered. Pressure applied in the pressure molding is not particularly limited but it is preferably not higher than 0.1 ton/cm$^2$. If a significantly high pressure is applied in the pressure molding of the mixed powder, the provisional sintered body is to get hardened so that the pulverizing operation in a subsequent pulverizing step S3 may have difficulty.

In a pulverizing step S3, the Mo—Cr solid solution is pulverized by using a pulverizer (for example, a planetary ball mill), thereby obtaining a powder of the Mo—Cr solid solution (hereinafter referred to as "a Mo—Cr powder"). An atmosphere applied in pulverization in the pulverizing step S3 is preferably a non-oxidizing atmosphere, but a pulverization in the air may also be acceptable. A pulverizing condition is required only to be such an extent as to be able to pulverize particles (secondary particles) where Mo—Cr solid solution particles are bonded to each other. Incidentally, in pulverization of the Mo—Cr solid solution, a longer pulverization time makes the average particle diameter of the Mo—Cr solid solution particles smaller. Hence, the case of the Mo—Cr powder is provided with a pulverizing condition where the volume-based relative particle amount of particles having a particle diameter of 30 μm or less (more preferably, particles having a particle diameter of 20 μm or less) is not lower than 50%, thereby obtaining an electrode material in which Mo—Cr particles (where Mo and Cr are dissolved and diffused into each other) and a Cu structure are uniformly dispersed (that is, an electrode material excellent in the withstand voltage capability).

In a pressure molding step S4, molding of the Mo—Cr powder is conducted. The molding of the Mo—Cr powder is performed by press-molding the Mo—Cr powder at a pressure of 2 ton/cm$^2$, for example.

In a sintering step S5, the molded Mo—Cr powder is subjected to a main sintering, thereby obtaining a Mo—Cr sintered body (hereinafter referred to as "a sintered body"). The main sintering is performed by sintering the molded body of the Mo—Cr powder at 1150° C. for 2 hours in vacuum atmosphere, for example. The sintering step S5 is a step of producing a denser Mo—Cr sintered body by deforming and bonding the Mo—Cr powder. Sintering of the Mo—Cr powder is preferably conducted under a temperature condition of an infiltration step S7, for example, at a temperature of 1150° C. or higher. This is because, if sintering is performed at a temperature lower than an infiltration temperature, gas contained in the sintered body comes to up newly at the time of Cu infiltration and remains in a Cu-infiltrated body thereby possibly behaving as a factor for impairing the withstand voltage capability and current-interrupting capability. The sintering temperature employed in the present invention is a temperature higher than the Cu infiltration temperature and not higher than the melting point of Cr, preferably a temperature ranging from 1150° C. to 1500° C. Within the above-mentioned range, densification of the Mo—Cr particles is accelerated and degasification of the Mo—Cr particles is sufficiently developed. Incidentally, a sintered body subjected to a HIP treatment also can be obtained by directly conducting a HIP treatment step S6 without conducting the sintering step S5.

In a HIP treatment step S6, the obtained sintered body (or the molded body of Mo—Cr powder) is subjected to a HIP treatment. A treatment temperature applied in the HIP treatment is not particularly limited insofar as it is less than the melting point of the sintered body (or that of Mo—Cr powder). That is, the treatment temperature and the treatment pressure applied in the HIP treatment are suitably determined according to the performances that an electrode material is required to have. For example, the HIP treatment is conducted at a treatment temperature of 700 to 1100° C., a treatment pressure of 30 to 100 MPa and a treatment time of 1 to 5 hours, thereby it is possible to control a filling rate of the sintered body after the HIP treatment to be improved by 10% or more as compared with that of the sintered body before the HIP treatment.

In a Cu infiltration step S7, the sintered body having undergone the HIP treatment (hereinafter referred as "HIP treated body") is infiltrated with Cu. Infiltration with Cu is performed by disposing a Cu plate material onto the HIP treated body and keeping it in a non-oxidizing atmosphere at a temperature of not lower than the melting point of Cu for a certain period of time (e.g. at 1150° C. for two hours), for example.

Figure 2:
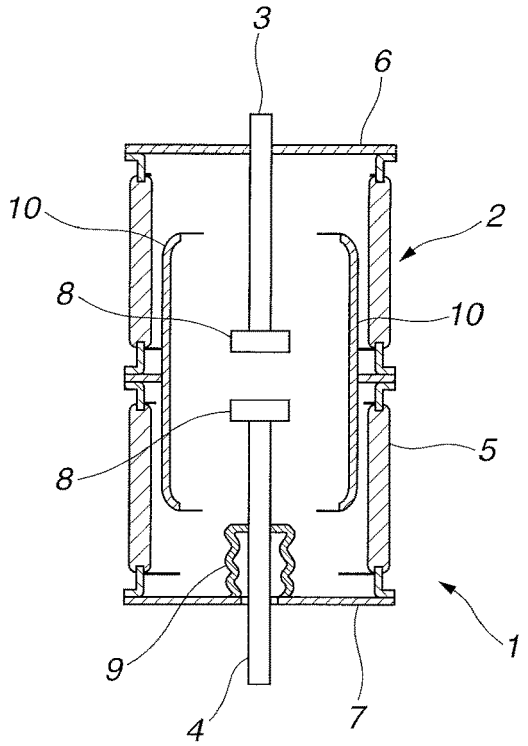
FIG. 2 A schematic cross-sectional view of a vacuum interrupter including an electrode material produced by the method for producing an electrode material according to the embodiment of the present invention.

Furthermore, it is possible to construct a vacuum interrupter by using an electrode material produced by a method for producing an electrode material according to an embodiment of the present invention. As shown in FIG. 2, a vacuum interrupter 1 including an electrode material according to an embodiment of the present invention is provided to include a vacuum vessel 2, a fixed electrode 3, a movable electrode 4 and a main shield 10.

The vacuum vessel 2 is configured such that an insulating cylinder 5 is sealed at its both opening ends with a fixed-side end plate 6 and a movable-side end plate 7, respectively.

The fixed electrode 3 is fixed in a state of penetrating the fixed-side end plate 6. The fixed electrode 3 is fixed in such a manner that its one end is opposed to one end of the movable electrode 4 in the vacuum vessel 2, and additionally, provided with an electrode contact material 8 (serving as an electrode material according to an embodiment of the present invention) at an end portion opposing to the movable electrode 4.

The movable electrode 4 is provided at the movable-side end plate 7. The movable electrode 4 is disposed coaxial with the fixed electrode 3. The movable electrode 4 is moved in the axial direction by a non-illustrated opening/closing means, with which an opening/closing action between the fixed electrode 3 and the movable electrode 4 is attained. The movable electrode 4 is provided with an electrode contact material 8 at an end portion opposing to the fixed electrode 3. Between the movable electrode 4 and the movable-side end plate 7, a bellows 9 is disposed, so that the movable electrode 4 can vertically be moved to attain the opening/closing action between the fixed electrode 3 and the movable electrode 4 while keeping the vacuum state of the vacuum vessel 2.

The main shield 10 is mounted to cover a contact part of the electrode contact material 8 of the fixed electrode 3 and the electrode contact material 8 of the movable electrode 4, so as to protect the insulating cylinder 5 from an arc generated between the fixed electrode 3 and the movable electrode 4.

EXAMPLE 1

Referring now to a concrete example, a method for producing an electrode material and an electrode material according to an embodiment of the present invention will be discussed in details. An electrode material of Example 1 is an electrode material produced according to the flow chart as shown in FIG. 1.

A Mo powder and a Cr powder were sufficiently uniformly mixed at a weight ratio of Mo:Cr=9:1 as a mixing ratio by using a V type blender.

As the Mo powder, a powder having a particle diameter of 0.8 to 6.0 μm was employed. As the result of measuring the particle diameter distribution of this Mo powder by using a laser diffraction particle size analyzer, it was confirmed to have a median diameter d50 of 5.1 μm (and d10 of 3.1 μm and d90 of 8.8 μm). The Cr powder was a powder of −325 mesh (mesh opening of 45 μm).

After the mixing operation was completed, the mixed powder containing the Mo powder and the Cr powder was moved into an alumina container, followed by conducting a provisional sintering for the mixed powder at 1250° C. for three hours in a vacuum furnace. The vacuum furnace had a degree of vacuum of $3.5\times10^{-3}$ Pa after performing sintering at 1250° C. for three hours. Incidentally, if the degree of vacuum after keeping the powder at the provisional sintering temperature for a certain period of time is not larger than $5\times10^{-3}$ Pa, an electrode material produced from the thus obtained provisional sintered body is so reduced in oxygen content as not to impair the current-interrupting capability of the electrode material.

After cooling, the Mo—Cr provisional sintered body was taken out from the vacuum furnace and then pulverized by using a planetary ball mill for ten minutes, thereby obtaining a Mo—Cr powder. After pulverization, the Mo—Cr powder was subjected to X ray diffraction (XRD) measurement to determine the crystal constant of the Mo—Cr powder. The lattice constant a of the Mo—Cr powder (Mo:Cr=9:1) was 0.3118 nm. Incidentally, the lattice constant a of the Mo powder (Mo) was 0.3151 nm while the lattice constant a of the Cr powder (Cr) was 0.2890 nm.

As the result of the X ray diffraction (XRD) measurement made on the Mo—Cr powder (Mo:Cr=9:1), peaks corresponding to 0.3151 nm and 0.2890 nm were confirmed to have disappeared. It is found from this that Mo element and Cr element are dispersed in each other in solid phase by performing the provisional sintering thereby changing Mo and Cr into a solid solution.

In observing the Mo—Cr powder by an electron microscope, relatively large particles having a particle diameter of about 45 μm were not observed. Furthermore, it was confirmed that Cr did not exist in a state of a raw material in terms of size. Moreover, the average particle diameter (the median diameter d50) of the Mo—Cr powder was 15.1 μm.

From the result of the X ray diffraction (XRD) measurement and from the electron micrographs, it is assumed that Cr is fined by sintering at 1250° C. for three hours after mixing Mo an Cr and that then Mo and Cr are diffused into each other thereby forming a solid solution of Mo and Cr.

Thereafter, the Mo—Cr powder obtained in the pulverizing step was press-molded under a pressure of 2.3 ton/cm$^2$ in use of a press machine to obtain a molded body (diameter of 60 mm, height of 10 mm). This molded body was subjected to a main sintering at 1150° C. for 1.5 hours in vacuum atmosphere, thereby having obtained a sintered body.

The sintered body was charged into a stainless steel cylindrical vessel (having an inside height of 11 mm, an inside diameter of 62 mm and a wall thickness of 5 mm) and vacuum-sealed therein, followed by being subjected to a HIP treatment within a HIP treatment device at 1050° C. and 70 MPa (0.714 ton/cm$^2$) for 2 hours.

To be specific, a carbon sheet (having a diameter of 62 mm and a thickness of 0.4 mm) was laid on the bottom surface of the cylindrical vessel, and then the sintered body was disposed thereon. In addition, a carbon sheet was also provided between the sintered body and the inner wall of the cylindrical vessel. Upon mounting a further carbon sheet on the sintered body, a top lid (having a thickness of 5 mm) was put on the upper opening of the cylindrical vessel. The cylindrical vessel was previously formed to have a step-like portion at its upper inner wall, and the top lid was arranged to be loosely fitted into this step-like portion. By thus interposing the carbon sheet between the sintered body and the inner wall, a melt adhesion between the sintered body and the inner wall due to the HIP treatment can be prevented.

Thereafter, the cylindrical vessel housing the sintered body therein was put into a vacuum equipment and evacuated up to $1.0\times10^{-3}$ Pa. By performing the evacuation step, the interior of the cylindrical vessel (namely, a space in which the sintered body was disposed) was also evacuated up to $1.0\times10^{-3}$ Pa through a gap between the upper opening of the cylindrical vessel and the top lid. Subsequently, the cylindrical vessel was subjected to welding in the vacuum equipment at the gap between the upper opening of the cylindrical vessel and the top lid by electron beam, thereby being vacuum-sealed.

The thus vacuum-sealed cylindrical vessel was subjected to the HIP treatment (1050° C., 70 MPa, 2 hours), and after the HIP treatment, a portion welded by electron beam was lathed. Since the carbon sheet never adheres to the cylindrical vessel and the sintered body at a heat treatment temperature of 1050° C., it was possible to obtain a HIP-treated body only by removing the carbon sheet having been bonded to the top, bottom and side surfaces of the HIP-treated body. As the result of measuring the filling rate of the HIP-treated body by measuring the outer diameter and the thickness of the HIP-treated body, it was confirmed that the filling rate was 66.8%. Upon conducting ultrasonic cleaning with acetone on this HIP-treated body, a Cu plate was placed on the HIP-treated body, followed by carrying out Cu infiltration at 1150° C. for 2 hours in a vacuum atmosphere (or a non-oxidizing atmosphere).

REFERENCE EXAMPLE 1

Figure 3:
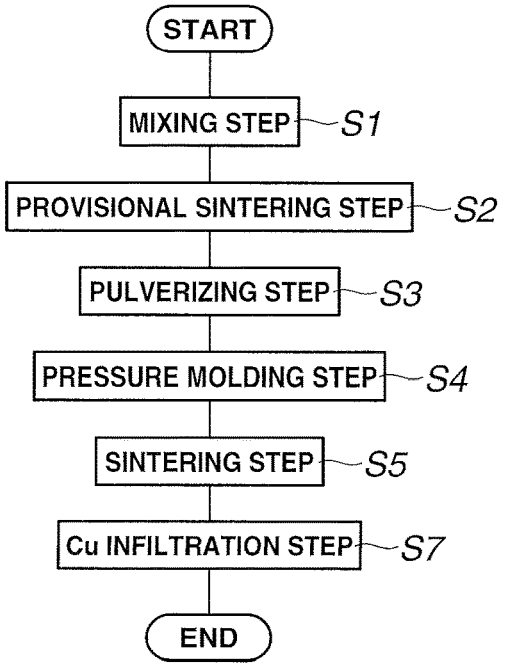
FIG. 3 A flow chart showing a method for producing an electrode material according to Reference Examples 1 to 6.

An electrode material of Reference Example 1 is an electrode material produced by the same procedure as that of Example 1 with the exception that the HIP treatment is not performed. The electrode material of Reference Example 1 is an electrode material produced according to the flow chart as shown in FIG. 3. In the flow chart as shown in FIG. 3, steps common with Example 1 are given the same reference numeral; therefore, specific explanations on such steps are omitted.

A Mo powder and a Cr powder were mixed at a weight ratio of Mo:Cr=9:1. A mixed powder was provisionally sintered, and an obtained Mo—Cr solid solution was pulverized. Pressure molding was conducted to a powder obtained by pulverizing the Mo—Cr solid solution under a pressing pressure of 2.3 ton/cm$^2$ to obtain a molded body having a diameter of 60 mm and a height of 10 mm. This molded body was subjected to a heat treatment in a vacuum atmosphere at 1150° C. for 1.5 hours, thereby producing a sintered body. A filling rate of the sintered body was 50.7%.

The sintered body was then infiltrated with Cu to serve as the electrode material of Reference Example 1.

EXAMPLE 2

An electrode material of Example 2 is an electrode material produced by the same procedure as that of Example 1 with the exception that the pressure applied in the pressure molding step S4 is modified.

As shown in FIG. 1, a Mo powder and a Cr powder were mixed at a weight ratio of Mo:Cr=9:1. A mixed powder was provisionally sintered, and an obtained Mo—Cr solid solution was pulverized. Pressure molding was conducted to a powder obtained by pulverizing the Mo—Cr solid solution under a pressing pressure of 3.5 ton/cm$^2$ to obtain a molded body having a diameter of 60 mm and a height of 10 mm. This molded body was subjected to a heat treatment in a vacuum atmosphere at 1150° C. for 1.5 hours, thereby producing a sintered body. A filling rate of the sintered body was 54.9%. On this sintered body, a HIP treatment was performed at 1050° C., 70 MPa for 2 hours. A filling rate after the HIP treatment was 68.6%. The HIP-treated body was then infiltrated with Cu to serve as the electrode material of Example 2.

EXAMPLE 3

An electrode material of Example 3 is an electrode material produced by the same procedure as that of Example 1 with the exception that the pressure applied in the pressure molding step S4 is modified.

As shown in FIG. 1, a Mo powder and a Cr powder were mixed at a weight ratio of Mo:Cr=9:1. A mixed powder was provisionally sintered, and an obtained Mo—Cr solid solution was pulverized. Pressure molding was conducted to a powder obtained by pulverizing the Mo—Cr solid solution under a pressing pressure of 4.1 ton/cm$^2$ to obtain a molded body having a diameter of 60 mm and a height of 10 mm. This molded body was subjected to a heat treatment in a vacuum atmosphere at 1150° C. for 1.5 hours, thereby producing a sintered body. A filling rate of the sintered body was 57.0%. On this sintered body, a HIP treatment was performed at 1050° C., 70 MPa for 2 hours. A filling rate after the HIP treatment was 69.9%. The HIP-treated body was then infiltrated with Cu to serve as the electrode material of Example 3.

EXAMPLE 4

An electrode material of Example 4 is an electrode material produced by the same procedure as that of Example 1 with the exception that the mixing ratio between Mo and Cr applied in the mixing step S1 is modified.

As shown in FIG. 1, a Mo powder and a Cr powder were mixed at a weight ratio of Mo:Cr=7:1. A mixed powder was provisionally sintered, and an obtained Mo—Cr solid solution was pulverized. A powder obtained by pulverizing the Mo—Cr solid solution was subjected to XRD measurement to determine a crystal constant. As a result, a lattice constant a was 0.3107 nm. Pressure molding was conducted to this powder under a pressing pressure of 2.3 ton/cm$^2$ to obtain a molded body having a diameter of 60 mm and a height of 10 mm. This molded body was subjected to a heat treatment in a vacuum atmosphere at 1150° C. for 1.5 hours, thereby producing a sintered body. A filling rate of the sintered body was 51.2%. On this sintered body, a HIP treatment was performed at 1050° C., 70 MPa for 2 hours. A filling rate after the HIP treatment was 66.7%. The HIP-treated body was then infiltrated with Cu to serve as the electrode material of Example 4.

EXAMPLE 5

An electrode material of Example 5 is an electrode material produced by the same procedure as that of Example 4 with the exception that the pressure applied in the pressure molding step S4 is modified.

As shown in FIG. 1, a Mo powder and a Cr powder were mixed at a weight ratio of Mo:Cr=7:1. A mixed powder was provisionally sintered, and an obtained Mo—Cr solid solution was pulverized. Pressure molding was conducted to a powder obtained by pulverizing the Mo—Cr solid solution under a pressing pressure of 3.5 ton/cm$^2$ to obtain a molded body having a diameter of 60 mm and a height of 10 mm. This molded body was subjected to a heat treatment in a vacuum atmosphere at 1150° C. for 1.5 hours, thereby producing a sintered body. A filling rate of the sintered body was 55.1%. On this sintered body, a HIP treatment was performed at 1050° C., 70 MPa for 2 hours. A filling rate after the HIP treatment was 68.0%. The HIP-treated body was then infiltrated with Cu to serve as the electrode material of Example 5.

EXAMPLE 6

An electrode material of Example 6 is an electrode material produced by the same procedure as that of Example 4 with the exception that the pressure applied in the pressure molding step S4 is modified.

As shown in FIG. 1, a Mo powder and a Cr powder were mixed at a weight ratio of Mo:Cr=7:1. A mixed powder was provisionally sintered, and an obtained Mo—Cr solid solution was pulverized. Pressure molding was conducted to a powder obtained by pulverizing the Mo—Cr solid solution under a pressing pressure of 4.1 ton/cm$^2$ to obtain a molded body having a diameter of 60 mm and a height of 10 mm. This molded body was subjected to heat treatment in a vacuum atmosphere at 1150° C. for 1.5 hours, thereby producing a sintered body. A filling rate of the sintered body was 56.9%. On this sintered body, a HIP treatment was performed at 1050° C., 70 MPa for 2 hours. A filling rate after the HIP treatment was 69.7%. The HIP-treated body was then infiltrated with Cu to serve as the electrode material of Example 6.

REFERENCE EXAMPLES 2 TO 6

As Reference Examples 2 to 6 corresponding to Examples 2 to 6, electrode materials were produced by the same procedures as those of Examples 2 to 6, respectively, with the exception that the HIP treatment was not performed.

The results of measuring the electrode materials of Examples 1 to 6 and Reference Examples 1 to 6 in terms of micro-Vickers hardness and impulse withstand voltage are shown in Table 1. Table 1 also shows the results of measuring Examples 1 to 6 in terms of filling rates that the sintered body had before and after the HIP treatment and the results of measuring Reference Examples 1 to 6 in terms of filling rates after the sintering step.

The measurement of impulse withstand voltage was carried out upon processing each of the electrode materials into a disc electrode having a diameter of 25 mm as an electrode material for use in a vacuum interrupter and measuring 50% flashover voltage (the same goes for the other Examples (Comparative Examples, Reference Examples)). In samples subjected to the HIP treatment (Examples 1 to 6), carbides of Mo and Cr have been formed from a surface of a HIP-treated body up to the depth of about 100 μm as carbon sheets were used in the HIP treatment. However, the carbides of Mo and Cr have been completely removed by a machining lathe in working of the electrode. Furthermore, in Table 1, the withstand voltage is expressed by a value relative to an electrode material produced under the same conditions with the exception of the presence or absence of the HIP treatment; namely, the withstand voltage is expressed by a relative value based on an electrode material on which the HIP treatment was not conducted (wherein the standard value is one).

TABLE 1

| | Mo particle diameter (μm) | Cr particle diameter (μm) | Mixing Ratio Mo:Cr | Pressure applied in press molding Mo—Cr sintered powder (ton/cm$^2$) | Filling rate after sintering (%) | Presence or absence of HIP treatment | Filling rate after HIP treatment (%) | Vickers hardness after Cu infiltration (Hv) | Relative withstand voltage |
|---|---|---|---|---|---|---|---|---|---|
| Example 1 | 0.8-6.0 | 45 | 9:1 | 2.3 | 51.0 | Done | 66.8 | 353 | 1.17 |
| Reference Example 1 | 0.8-6.0 | 45 | 9:1 | 2.3 | 50.7 | Not done | | 235 | 1 |
| Example 2 | 0.8-6.0 | 45 | 9:1 | 3.5 | 54.9 | Done | 68.6 | 367 | 1.18 |
| Reference Example 2 | 0.8-6.0 | 45 | 9:1 | 3.5 | 55.7 | Not done | | 240 | 1 |
| Example 3 | 0.8-6.0 | 45 | 9:1 | 4.1 | 57.0 | Done | 69.9 | 369 | 1.20 |
| Reference Example 3 | 0.8-6.0 | 45 | 9:1 | 4.1 | 57.3 | Not done | | 259 | 1 |
| Example 4 | 0.8-6.0 | 45 | 7:1 | 2.3 | 51.2 | Done | 66.7 | 374 | 1.17 |
| Reference Example 4 | 0.8-6.0 | 45 | 7:1 | 2.3 | 49.9 | Not done | | 257 | 1 |
| Example 5 | 0.8-6.0 | 45 | 7:1 | 3.5 | 55.1 | Done | 68.0 | 377 | 1.15 |
| Reference Example 5 | 0.8-6.0 | 45 | 7:1 | 3.5 | 55.2 | Not done | | 259 | 1 |
| Example 6 | 0.8-6.0 | 45 | 7:1 | 4.1 | 56.9 | Done | 69.7 | 376 | 1.20 |
| Reference Example 6 | 0.8-6.0 | 45 | 7:1 | 4.1 | 57.2 | Not done | | 253 | 1 |

As shown in Table 1, it was confirmed that when performing the HIP treatment, the micro-Vickers hardness after the Cu infiltration was improved while enhancing the withstand voltage by 15 to 20% as compared with that of an electrode material on which the HIP treatment was not conducted.

[Cross-Sectional Observation of Electrode Material]

According to observation of a cross section of the electrode material of Example 1 by an electron microscope, fine alloy structures of 1 to 10 μm were uniformly fined and dispersed. Additionally, Cu structures were also uniformly dispersed without any uneven distribution.

COMPARATIVE EXAMPLE 1

Figure 4:
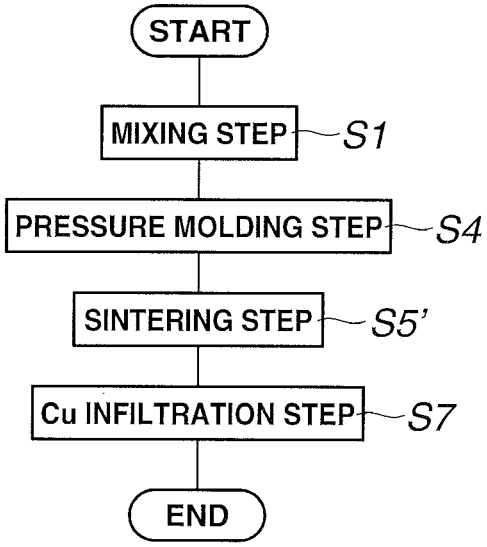
FIG. 4 A flow chart showing a method for producing an electrode material according to Comparative Examples 1 and 2.

An electrode material of Comparative Example 1 is an electrode material produced by the same procedure as that of Example 3 with the exception that the provisional sintering step S2, pulverizing step S3, and HIP treatment step S6 are not performed. The electrode material of Comparative Example 1 was produced according to the flow chart as shown in FIG. 4. In the flow chart as shown in FIG. 4, steps common with the flow chart of FIG. 1 are given the same reference numeral. Therefore, specific explanations on such steps are omitted.

As shown in FIG. 4, a Mo powder and a Cr powder were mixed at a weight ratio of Mo:Cr=9:1. Pressure molding was conducted to this mixed powder under a pressing pressure of 4.1 ton/cm$^2$ to obtain a molded body having a diameter of 60 mm and a height of 10 mm. This molded body was subjected to a heat treatment in a vacuum atmosphere at 1200° C. for 2 hours, thereby producing a sintered body. A filling rate of the sintered body was 61.0%. The sintered body was then infiltrated with Cu to serve as the electrode material of Comparative Example 1.

COMPARATIVE EXAMPLE 2

An electrode material of Comparative Example 2 is an electrode material produced by the same procedure as that of Comparative Example 1 with the exception that the mixing ratio between Mo and Cr applied in the mixing step S1 is modified.

As shown in FIG. 4, a Mo powder and a Cr powder were mixed at a weight ratio of Mo:Cr=7:1. Pressure molding was conducted to this mixed powder under a pressing pressure of 4.1 ton/cm$^2$ to obtain a molded body having a diameter of 60 mm and a height of 10 mm. This molded body was subjected to heat treatment in a vacuum atmosphere at 1200° C. for 2 hours, thereby producing a sintered body. A filling rate of the sintered body was 65.1%. The sintered body was then infiltrated with Cu to serve as the electrode material of Comparative Example 2.

REFERENCE EXAMPLE 7

Figure 5:
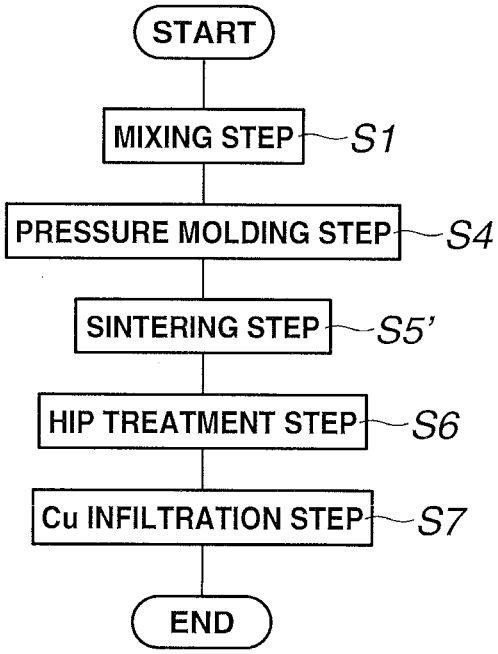
FIG. 5 A flow chart showing a method for producing an electrode material according to Reference Examples 7 and 8.

An electrode material of Reference Example 7 is an electrode material produced by the same procedure as that of Example 3 with the exception that the provisional sintering step S2 and pulverizing step S3 are not performed. The electrode material of Reference Example 7 was produced according to the flow chart as shown in FIG. 5. In the flow chart as shown in FIG. 5, steps common with the flow chart of FIG. 1 are given the same reference numeral. Therefore, specific explanations on such steps are omitted.

As shown in FIG. 5, a Mo powder and a Cr powder were mixed at a weight ratio of Mo:Cr=9:1. Pressure molding was conducted to this mixed powder under a pressing pressure of 4.1 ton/cm$^2$ to obtain a molded body having a diameter of 60 mm and a height of 10 mm. This molded body was subjected to heat treatment in a vacuum atmosphere at 1200° C. for 2 hours, thereby producing a sintered body. A filling rate of the sintered body was 60.6%. On this sintered body, a HIP treatment was performed at 1050° C., 70 MPa for 2 hours. A filling rate after the HIP treatment was 76.1%. The HIP-treated body was then infiltrated with Cu to serve as the electrode material of Reference Example 7.

REFERENCE EXAMPLE 8

An electrode material of Reference Example 8 is an electrode material produced by the same procedure as that of Reference Example 7 with the exception that the mixing ratio between Mo and Cr applied in the mixing step S1 is modified.

As shown in FIG. 5, a Mo powder and a Cr powder were mixed at a weight ratio of Mo:Cr=7:1. Pressure molding was conducted to this mixed powder under a pressing pressure of 4.1 ton/cm$^2$ to obtain a molded body having a diameter of 60 mm and a height of 10 mm. This molded body was subjected to a heat treatment in a vacuum atmosphere at 1200° C. for 2 hours, thereby producing a sintered body. A filling rate of the sintered body was 65.1%. On this sintered body, a HIP treatment was performed at 1050° C., 70 MPa for 2 hours. A filling rate after the HIP treatment was 75.3%. The HIP-treated body was then infiltrated with Cu to serve as the electrode material of Reference Example 8.

The results of measuring the electrode materials of Comparative Examples 1 and 2, and Reference Examples 7 and 8 in terms of micro-Vickers hardness and impulse withstand voltage are shown in Table 2. Table 2 also shows the result of measuring Comparative Examples 1 and 2 in terms of filling rates that the sintered body had after the sintering step and the results of measuring Reference Example 7 and 8 in terms of filling rates that the sintered body had before and after the HIP treatment. Furthermore, the withstand voltage in Table 2 is expressed by a relative value based on an electrode material on which the HIP treatment was not conducted (wherein the standard value is one) with respect to mixing ration of Mo powder and Cr powder and pressure applied in pressure molding on the same condition (that is, the electrode of Reference Example 3 or Reference Example 6 in Table 1).

Furthermore, according to the results of measuring the electrode materials of Reference Examples 7 and 8 in terms of Vickers hardness and withstand voltage, in case of conducting the HIP treatment, their Vickers hardness have been improved and their withstand voltage capability also have been improved. These results suggests that withstand voltage capability and current-interrupting capability are improved by conducting the HIP treatment even if the Mo powder and Cr powder are not subjected to the provisional sintering and the solid phase diffusion in advance.

Furthermore, according to the results of measuring the electrode materials of Examples 3 and 6 in terms of Vickers hardness and withstand voltage in Table 1, an electrode material having more excellent withstand voltage capability and current-interrupting capability can be obtained by conducting both the step of provisionally sintering the Mo powder and Cr powder in advance and the step of conducting the HIP treatment.

Particularly, with regard to the electrodes of Examples 3 and 6 as compared with the electrodes of Reference Examples 7 and 8, as Mo—Cr solid solution powder has lower compressibility (lower filling rate), there is a risk of deteriorating formability. However, the formability is improved by conducting the HIP treatment. Therefore, it is possible to obtain an electrode material having more excellent withstand voltage capability as compared with the electrodes of Reference Examples 7 and 8.

According to the method for producing the electrode material and the electrode materials according to the embodiments of the present invention as described above, a solid solution powder which is obtained by provisionally sintering a Mo powder and Cr powder is molded, and the molded solid solution is subjected to a HIP treatment. After that, Cu is infiltrated into the HIP treated body, thereby it is possible to obtain an electrode material having excellent withstand voltage capability and current-interrupting capability.

That is, to conduct the HIP treatment makes constitution of the electrode material minute and highly hard. Thereby, the withstand voltage capability of the electrode material is

TABLE 2

| | Mo particle diameter (μm) | Cr particle diameter (μm) | Mixing Ratio Mo:Cr | Pressure applied in press molding (ton/cm$^2$) | Filling rate after sintering pressed body (%) | Presence or absence of HIP treatment | Filling rate after HIP treatment (%) | Vickers hardness after Cu infiltration (Hv) | Relative withstand voltage |
|---|---|---|---|---|---|---|---|---|---|
| Comparative Example 1 | 0.8-6.0 | 45 | 9:1 | 4.1 | 61.0 | Not done | | 237 | 0.95 |
| Comparative Example 2 | 0.8-6.0 | 45 | 7:1 | 4.1 | 65.1 | Not done | | 241 | 0.95 |
| Reference Example 7 | 0.8-6.0 | 45 | 9:1 | 4.1 | 60.6 | Done | 76.1 | 340 | 1.10 |
| Reference Example 8 | 0.8-6.0 | 45 | 7:1 | 4.1 | 65.1 | Done | 75.3 | 378 | 1.03 |

According to the results of measuring the electrode materials of Comparative Examples 1 and 2 in terms of Vickers hardness and withstand voltage, in case of not subjecting the Mo powder and Cr powder to the provisional sintering, their Vickers hardness are substantially same and their withstand voltage capability are deteriorated. These results suggests that the withstand voltage performance of the electrode material is improved by subjecting the Mo powder (heat resistant element) and Cr powder to the provisional sintering and a solid phase diffusion in advance.

improved. As a result, insulation recovering time in electrodes formed from the electrode material is shortened, thereby the current-interrupting capability of the electrode (electrode material) is improved.

Furthermore, a solid solution where Mo and Cr are dissolved and diffused is formed in advance, and after molding a solid solution powder, Cu is infiltrated into it. Thereby, it is possible to uniformly disperse the fine particles (the solid solution particles of a heat resistant element and Cr) where a heat resistant element and Cr are dissolved and diffused into each other in Cu. Furthermore, it is possible to uniformly disperse Cu structures without any uneven distribution. As a result, the withstand voltage capability and current-interrupting capability are improved.

Additionally, it is possible to obtain an electrode material excellent in withstand voltage capability and current-interrupting capability because Mo—Cr powder where Cr is made sufficiently minute can be obtained by increasing the content of a heat resistant element in the electrode material. Thus, by increasing the content of a heat resistant element in the electrode material more and more, the withstand voltage capability of the electrode material tends to be enhanced. A case of the electrode material containing a heat resistant element only (or a case where the electrode material does not contain Cr), however, sometimes makes the Cu infiltration difficult. Therefore, a ratio of Cr element to the heat resistant element in the solid solution powder is preferably 4 or less to 1, more preferably ⅓ or less to 1 by weight, thereby making it possible to provide an electrode material excellent in withstand voltage capability.

In the method for producing the electrode material and the electrode material according to the embodiments of the present invention, the filling rate of the sintered body (porous body) after the HIP treatment is controlled by controlling temperature, pressure, and time condition in the HIP treatment. For example, by conducting the HIP treatment under temperature, pressure, and time condition wherein the filling rate of a sintered body after the HIP treatment is improved by 10% or more as compared with a filling rate of a sintered body before the HIP treatment, the withstand voltage capability and current-interrupting capability can be improved.

Generally, in case of producing the electrode material through the infiltration method, to enhance pressure in molding is needed. in order to increase heat resistant components such as Cr and a heat resistant element. However, in order to add. high molding pressure, a large press machine is needed. For example, in the case of producing a molded body of 25 mm diameter by pressing it under a pressing pressure of 0.2 to 4.5 ton/cm$^2$, the required pressing pressure is 1.0 to 22.1 ton, and therefore such a pressing can be achieved in use of a press machine giving a 25 ton pressing performance. However, in the case of producing a molded body of 100 mm diameter by pressing it under a pressing pressure of 0.2 to 4.5 ton/cm$^2$, a press machine which can perform pressing of 15.7 to 353 ton is needed. That is, in order to obtain a molded body having a large diameter (for example, a diameter of not smaller than 100 mm), it is necessary to prepare a large press machine giving about 400 ton pressing performance. The introduction of the large press machine increases the cost and therefore extremely uneconomical. Moreover, a higher pressing pressure makes a mold more worn out so as to shorten the life of the mold. In particular, Mo—Cr solid solution powder has higher hardness of a powder and inferior compressibility in molding as compared with a Mo powder and Cr powder. Thereby, there is a risk of deteriorating formability. Therefore, in case of molding the Mo—Cr solid solution powder, it is considered that higher molding pressure is needed in order to obtain an electrode material having equal filling rate as compared with case of molding a mixed powder containing Mo powder and Cr powder.

On the other hand, in the method for producing the electrode material according to the present invention, it is possible to improve the filling rate of the sintered body (or molded body) by conducting the HIP treatment step before infiltration of highly conductive metal. That is, by conducting the HIP treatment under an atmosphere of high temperature and high pressure, the filling rate of Mo—Cr molded body can be improved with synergistic effect of the pressure and temperature. As a result, molding pressure in a pressure forming step can be reduced, and a manufacturing cost of an electrode material can be reduced.

In addition, the average particle diameter of a heat resistant element (such as Mo) may serve as a factor for determining the particle diameter of the solid solution powder of the heat resistant element and Cr. That is, because Cr particles are refined by heat resistant element particles and then diffused into the heat resistant element particles by its diffusion mechanism to form a solid solution structure of the heat resistant element and Cr, the particle diameter of the heat resistant element is increased by a provisional sintering. Furthermore, the degree of increase due to the provisional sintering also depends on the mixed ratio of Cr. Hence the heat resistant element is provided to have an average particle diameter of 2-20 μm, more preferably 2-10 μm; with this, it is possible to obtain a solid solution powder of the heat resistant element and Cr, which is for manufacturing an electrode material excellent in withstand voltage capability and current-interrupting capability.

Furthermore, the method for producing an electrode material according to an embodiment of the present invention produces the electrode material by the infiltration method. Therefore, the electrode material has a filling rate of 95% or more after infiltration of Cu so that it is possible to manufacture an electrode material where the damages that the contact surface is to receive by arcs generated at current-interrupting time or current-starting time are lessened. That is, an electrode material excellent in withstand voltage capability is obtained because on the surface of the electrode material there is no fine unevenness caused by the presence of airspaces. Additionally, the mechanical strength is excellent since airspaces of a porous material are charged with Cu, and it is superior in hardness to an electrode material produced by a sintering method, so it is possible to produce an electrode material having good withstand voltage capability.

Furthermore, if the electrode material according to the embodiment of the present invention is disposed at least at one of a fixed electrode and a movable electrode of a vacuum interrupter (VI), the withstand voltage capability of an electrode contact of the vacuum interrupter is to be improved. When the withstand voltage capability of the electrode contact is improved, a gap defined between the fixed electrode and the movable electrode can be shortened as compared with that of conventional vacuum interrupters and additionally a gap defined between the fixed electrode or the movable electrode and a main shield can also be shortened; therefore, it is possible to minify the structure of the vacuum interrupter. As a result, the vacuum interrupter may be reduced in size. Since the size of the vacuum interrupter can thus be reduced, it is possible to reduce the manufacturing cost of the vacuum interrupter.

Although the embodiments of the present invention have been described above by reference only to some specified preferable examples, the present invention is not limited to those. Various modifications and variations in the scope of the technical idea of the present invention will occur to those skilled in the art, and such variations and modifications are within the scope of the claims as a matter of course.

For example, the provisional sintering temperature is not lower than 1250° C. and not higher than the melting point of Cr, more preferably within a range of from 1250 to 1500° C.

With this, the mutual dispersion of Mo and Cr is sufficiently developed, and the subsequent pulverization of the Mo—Cr solid solution using a pulverizing machine is relatively easily performed. As a result, an electrode material can inexpensively be provided with excellent withstand voltage capability and current-interrupting capability. Furthermore, the sintering time of the provisional sintering is 1250° C.-more than 30 minutes, more preferably 1250° C.-three hours. Thus, the mutual dispersion of Mo and Cr is sufficiently developed, and Cr is made sufficiently fine. This provisional sintering time may be changed according to the provisional sintering temperature; for example, a provisional sintering at 1250° C. requires three hours as a preferable sintering time, but a provisional sintering at 1500° C. requires only a 0.5 hour of provisional sintering time.

Additionally, the Mo—Cr solid solution powder is not limited to the one produced according to the manufacturing method as discussed in the embodiments of the present invention, and therefore a Mo—Cr solid solution powder produced by any conventional manufacturing method (such as a jet mill method and an atomization method) is also acceptable.

Incidentally, the pressure molding step is not limited to a pressure molding which uses a press machine, which is feasible even by other molding methods such as cold isostatic pressing (CIP), casting, injection molding and extrusion.

Moreover, the electrode material of the present invention is not limited to the one consisting only of a heat resistant element, Cr and Cu. The addition of an element for improving the characteristics of the electrode material is also acceptable. For example, the addition of Te into the electrode material can improve the welding resistance of the electrode material.

The invention claimed is:

1. A method for producing an electrode material, comprising:

a provisional sintering step of sintering a mixed powder containing a powder of at least one heat resistant element selected from elements including Mo, W, Ta, Nb, V, and Zr and a powder of Cr to obtain a solid solution where the at least one heat resistant element and Cr are dissolved, the powder of the at least one heat resistant element having a content of 6 to 76 wt % relative to the electrode material and the powder of Cr having a content of 1.5 to 64 wt % relative to the electrode material, the powder of the at least one heat resistant element and the powder of Cr being mixed such that a weight ratio of Cr to the at least one heat resistant element is four or less to one;

a pulverizing step of pulverizing the solid solution to obtain a powder of the solid solution;

a hot isostatic pressing treatment step of subjecting a molded body formed by molding the powder of the solid solution or a sintered body of the molded body to a hot isostatic pressing treatment; and an infiltration step of infiltrating Cu and/or Ag into an objective body obtained by the hot isostatic pressing treatment after the hot isostatic pressing treatment, Cu and/or Ag having a content of 20 to 70 wt % relative to the electrode material.

2. The method for producing the electrode material as claimed in claim 1, wherein a filling rate of a molded body or a sintered body of the molded body after the hot isostatic pressing treatment is improved by 10% or more in the hot isostatic pressing treatment step, as compared with a filling rate of a molded body or a sintered body of the molded body before the hot isostatic pressing treatment.

3. The method for producing the electrode material as claimed in claim 1, wherein the content of the powder of the at least one heat resistant element relative to the electrode material is 32-68 wt %.

4. The method for producing the electrode material as claimed in claim 1, wherein the content of the powder of Cr relative to the electrode material is 4-15 wt %.

5. The method for producing the electrode material as claimed in claim 1, wherein an average particle diameter of the powder of the at least one heat resistant element is 2-20 μm, and wherein an average particle diameter of the powder of Cr is less than 300 μm.

6. The method for producing the electrode material as claimed in claim 1, wherein an average particle diameter of the powder of the at least one heat resistant element is 2-20 μm, and wherein an average particle diameter of the powder of Cr is less than 150 μm.

7. The method for producing the electrode material as claimed in claim 1, wherein an average particle diameter of the powder of the at least one heat resistant element is 2-10 μm, and wherein an average particle diameter of the powder of Cr is less than 45 μm.

8. The method for producing the electrode material as claimed in claim 1, wherein the content of the Cu and/or Ag relative to the electrode material is 25-60 wt %.

* * * * *